US005493203A

United States Patent [19]

Dalton

[11] Patent Number: 5,493,203

[45] Date of Patent: Feb. 20, 1996

[54] LOW QUIESCENT CURRENT VOLTAGE REGULATOR

[75] Inventor: Scott W. Dalton, Cypress, Tex.

[73] Assignee: Compaq Computer Corp., Houston, Tex.

[21] Appl. No.: 376,129

[22] Filed: Jan. 19, 1995

Related U.S. Application Data

[63] Continuation of Ser. No. 972,624, Nov. 6, 1992, abandoned.

[51] Int. Cl.[6] ..... G05F 1/44

[52] U.S. Cl. ..... 323/282; 323/351

[58] Field of Search ..... 323/282, 283, 323/265, 311, 349, 351

[56] References Cited

U.S. PATENT DOCUMENTS

| | | | |
|---|---|---|---|
| 4,319,179 | 3/1982 | Jett, Jr. | 323/281 |
| 4,733,159 | 3/1988 | Edwards et al. | 323/282 |
| 4,906,913 | 3/1990 | Stanojevic | 323/303 |
| 5,023,543 | 6/1991 | Tse | 323/314 |
| 5,105,144 | 4/1992 | Trump | 323/283 |
| 5,164,542 | 11/1992 | Hart | 174/35 MS |

*Primary Examiner*—Peter S. Wong
*Assistant Examiner*—Adolf Berhane
*Attorney, Agent, or Firm*—Pravel, Hewitt, Kimball & Krieger

[57] ABSTRACT

A low quiescent current voltage regulator particularly suited for providing current to the RTC/CMOS memory section of a notebook computer. The gate of the JFET is grounded, the drain connected to the main battery and the source connected to the RTC voltage input of the RTC/CMOS memory section. The JFET source voltage approaches the gate-source cutoff voltage of the JFET. This cutoff voltage is selected to be in the proper range for the RTC/CMOS memory section. A complete RTC voltage control circuit is configured to provide 5 volts from the system voltage when the computer is turned on, 3 to 5 volts from the JFET when the computer is turned off and the main battery is present and 3 volts from the RTC battery when the computer is turned off and the main battery is removed.

6 Claims, 2 Drawing Sheets

LOW QUIESCENT CURRENT VOLTAGE REGULATOR

This is a continuation of application Ser. No. 07/972,624 filed on Nov. 6, 1992 now abandoned.

BACKGROUND OF THE INVENTION

1. Field of the Invention

The invention relates to voltage regulators, and more particularly to very low quiescent current voltage regulators used for powering very low power devices.

2. Description of the Related Art

Notebook computers are quite common today and becoming both more prevalent and more powerful. As the capabilities of the computers increase, generally so does the amount of space required for the components. As notebook computers have general size limits, this results in increased packing densities and very complex internal arrangements. As a result, except for certain desired components, the various units comprising the circuitry of the computer become very difficult to access. One cannot simply remove the cover by loosening a few screws and access the components. Disassembly is a very delicate and time consuming task, and reassembly is the same. Thus it is desirable to reduce the need to access any internal components.

One item standard in notebook computers is a real time clock (RTC)/CMOS memory section. This section provides a clock and continuous memory capability even if the computer is turned off and/or the main battery is removed. To this end a separate battery, conventionally a lithium cell for size and life reasons, is used to provide a power source to the RTC/CMOS memory section when the computer is turned off. Thus the operations can continue as necessary. However, it has been determined that in many instances the useful life of the RTC battery may be a relatively short period such as two years. After that time the battery cannot provide sufficient energy to allow the RTC/CMOS memory section to properly operate and configuration and date/time errors begin occurring. Replacement of the RTC battery is then necessary. But this RTC battery is not one of the few accessible components and so disassembly and reassembly of the computer is necessary for replacement. As noted above, this is undesirable for numerous reasons. Therefore is desirable to lengthen the effective life of the RTC battery.

At first blush, it might be considered straightforward to simply provide a separate voltage regulator from the notebook computer's main battery to provide power when the computer is turned off and the main battery is present. However, known voltage regulators have a very high quiescent current draw, such as 1 mA. This is unacceptable, particularly when the RTC/CMOS memory section draws only microamperes of current. The high quiescent current will relatively rapidly drain the main battery, thus resulting in a dead computer, even though it was turned off in a fully charged state. Therefore this solution to the RTC battery life problem is not practical using conventional voltage regulators. Thus a low quiescent current voltage regulator is needed to allow use of the main battery to power the RTC/CMOS memory section instead of the RTC battery.

SUMMARY OF THE INVENTION

The present invention is a low quiescent current voltage regulator particularly suited for providing current to the RTC/CMOS memory section of a notebook computer. An n-channel JFET is connected between the main battery and the RTC/CMOS memory section voltage input. The gate of the JFET is grounded, the drain connected to the main battery and the source connected to the RTC voltage input through a small resistor. As the current drawn by the RTC/CMOS memory section is quite low, in this configuration the JFET source voltage approaches the gate-source cutoff voltage of the JFET. If this cutoff voltage is selected to be in the proper range for the RTC/CMOS memory section, voltage regulation then develops. This design thus results in a very low quiescent current as only a single active component is present, along with a few diodes and a simple resistor. Therefore the main battery is not rapidly drained but can provide the RTC voltage, greatly increasing the life of the RTC battery.

The complete RTC voltage control circuit is configured to provide 5 volts from the system voltage when the computer is turned on, 3 to 5 volts from the JFET when the computer is turned off and the main battery is present and 3 volts from the RTC battery when the computer is turned off and the main battery is removed.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
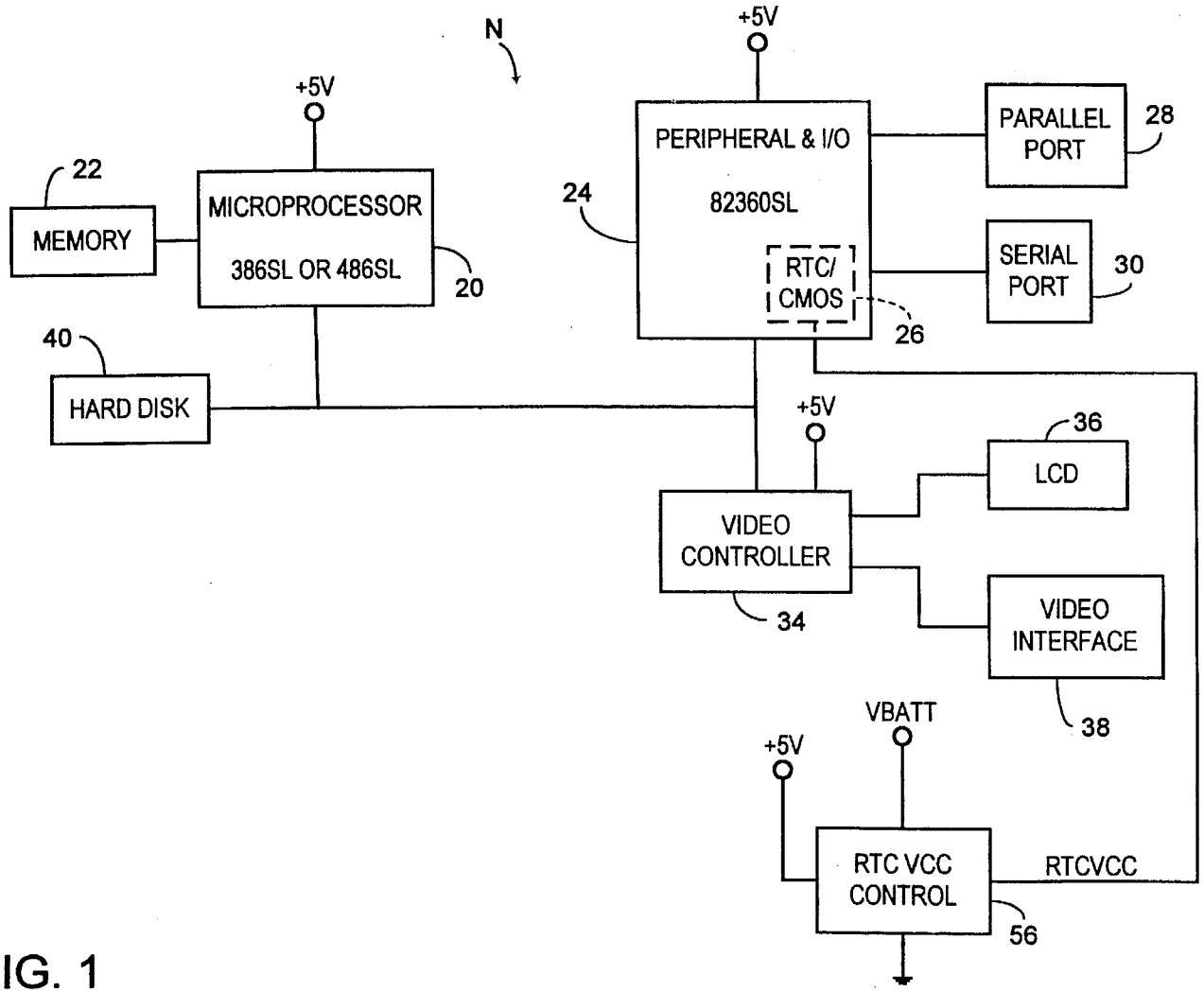
FIG. 1 is a block diagram of a notebook computer incorporating a voltage regulator according to the present invention in RTC voltage control circuitry.

Referring now to FIG. 1, a notebook computer N incorporating the present invention is generally shown. The notebook computer N includes a microprocessor 20, preferably the Intel Corporation 386SL or 486SL microprocessors with their special power down management capabilities. Memory 22 is connected to the microprocessor 20. When the microprocessor 20 is the 386SL or 486SL, a peripheral and input/output (I/O) chip 24, preferably the 82360SL from Intel, is utilized to perform the vast majority of remaining functions necessary for the notebook computer N. Of particular interest for the present description is that the peripheral and I/O chip 24 includes an RTC/CMOS memory section 26 which receives a special RTCVCC signal to provide voltage to the section 26. A parallel port 28 and a serial port 30 are also provided from the peripheral and I/O chip 24. A common bus 32 connects the microprocessor 20, the peripheral and I/O chip 24 and a video controller 34. The video controller 34 is connected an LCD display preferably contained in the notebook computer N and an external video interface 38. A hard disk unit 40 is connected to the bus 32 as is a transceiver 42. Connected to the transceiver 42 is a floppy disk controller 44 to which in turn is connected a floppy disk unit 46. A keyboard controller 48 is connected to the transceiver 42, with a keyboard 50 connected to the keyboard controller 48. Thus the basic operating components of the notebook computer N are shown. This has been a simplified description of a notebook computer N and of course it is understood that numerous variations can be developed. For example, the RTC/CMOS section 26 could be a completely independent unit or the various functional blocks could be rearranged as desired.

The notebook computer N obviously requires a power system. To this end a main battery 52 is utilized. It is understood that the main battery 52 could be either a single battery or could be a primary battery and an auxiliary battery combination. The main battery 52 is preferably removable to allow periodic replacement, such as when nonfunctional or two batteries are being interchanged. The main battery 52 is connected to ground and provides a signal referred to as VBATT which is the battery voltage. The VBATT signal is provided from the positive end of the main battery 52 and is provided to a DC—DC converter 54. The DC—DC converter 54 preferably provides a system output voltage signal of +5 V utilized by the various other components in the notebook computer N. An on/off switch 58 is provided between the VBATT signal and the DC—DC converter 54 to act as the on/off switch from the notebook computer N. The switch 58 can take many forms and is provided only representatively in FIG. 1. If the on/off switch 58 is opened, the DC—DC converter 54 is disabled and the +5 V signal is not produced.

This +5 V signal is also provided to RTC voltage control circuitry 56, which incorporates a voltage regulator according to the present invention. The VBATT signal is also provided to the RTC voltage control circuitry 56. The output of the RTC voltage control circuitry 56 is the RTCVCC signal, which is provided to the RTC/CMOS memory section 26 at its voltage input. The purpose of the RTC voltage control circuitry 56 is to select among a series of voltage sources to provide the proper voltage to the RTC/CMOS memory section 26.

Figure 2:
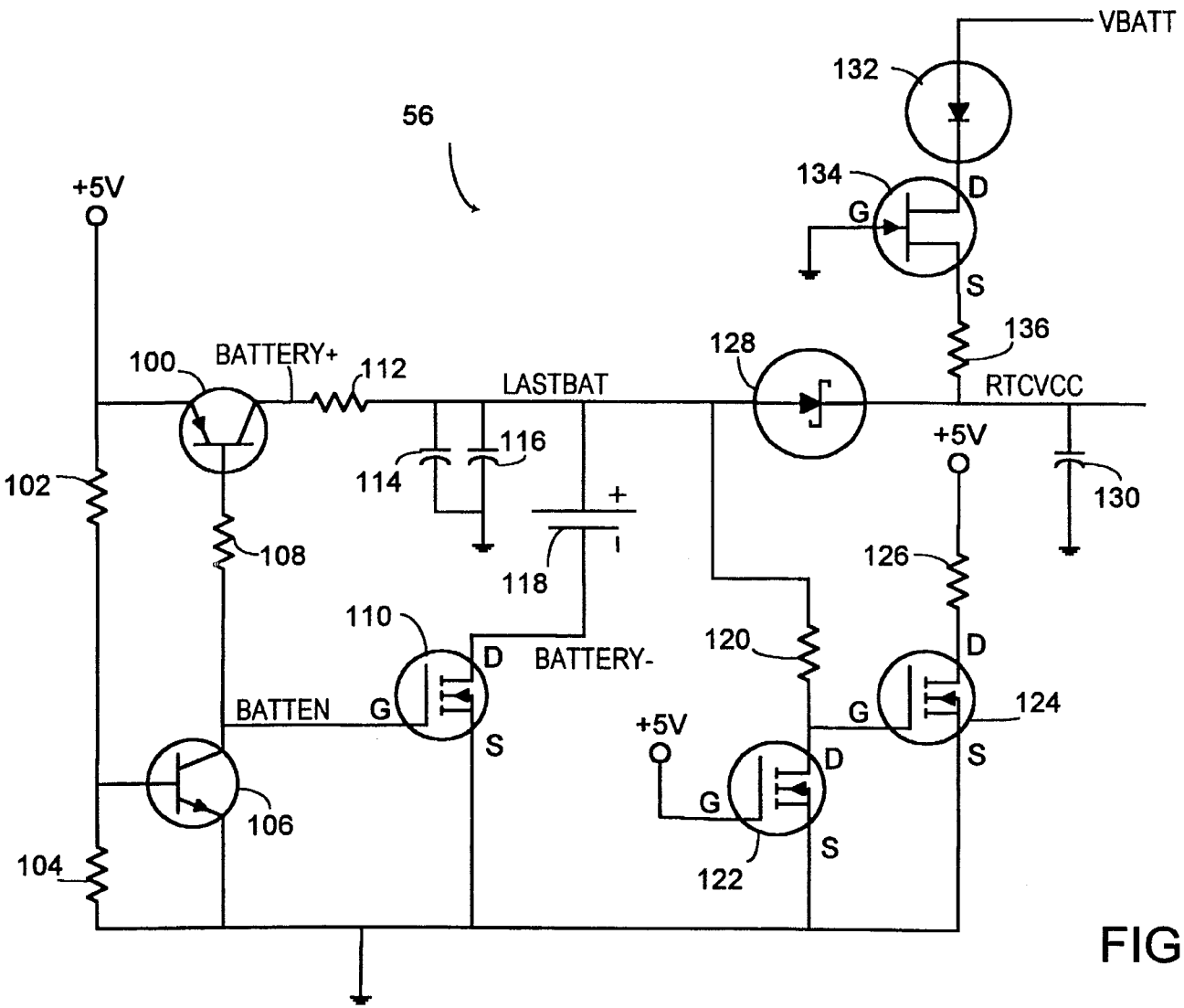
FIG. 2 is a schematic diagram of the RTC voltage control circuitry of FIG. 1.

Referring now to FIG. 2, the RTC voltage control circuitry 56 is shown in detail. The +5 V or system voltage signal is provided to the emitter of a PNP transistor 100 and to one terminal of a resistor 102. The second terminal of the resistor 102 is connected to the first terminal of a resistor 104 and the base of an NPN transistor 106. The second terminal of the resistor 104 and the emitter of the transistor 106 are connected to ground. A resistor 108 has one terminal connected to the base of the transistor 100 and its second terminal connected to the collector of the transistor 106. Further, the collector of the transistor 106 is connected to the gate of an N-channel enhancement MOSFET 110. The source of the MOSFET 110 is connected to ground.

The collector of the transistor 100 is connected to one terminal of a resistor 112 whose other terminal provides the LASTBATT signal. Parallel capacitors 114 and 116 are provided between the LASTBATT signal and ground to provide system voltage input decoupling. An RTC battery 118 is connected between the LASTBATT signal and the drain of the MOSFET 110. The battery 118 is preferably a lithium battery which has an output voltage of approximately 3 volts and which is a conventional RTC battery as used according to the prior art.

A resistor 120 has one terminal connected to the LASTBATT signal and its second terminal connected to the drain of an N-channel enhancement MOSFET 122 and the gate of an N-channel enhancement MOSFET 124. The gate of the MOSFET 122 is connected to the +5 V signal and the source is connected to ground. The source of the MOSFET 124 is connected to ground, while the drain is connected to one terminal of a resistor 126 whose second terminal is connected to the +5 V signal. The final connection to the LASTBATT signal is the anode of a Schottky diode 128. The cathode of the diode 128 is connected to the RTCVCC signal. A capacitor 130 is connected between the RTCVCC signal and ground to provide filtering. A Zener diode could be added between the RTCVCC signal and ground to prevent possible overvoltage conditions.

The VBATT signal is provided to the anode of a diode 132 with the cathode connected to the drain of an N-channel JFET 134. The gate of the JFET 134 is connected to ground while the source is connected to one terminal of a resistor 136 whose other terminal is connected to the RTCVCC signal.

The general operation of the RTC control circuit 56 is to provide +5 volts to the RTCVCC signal from the +5 V signal which is present when the notebook computer N is turned on, provide voltage via the JFET 134 from the VBATT signal when the notebook computer N is turned off and a main battery 52 is present and to provide energy or voltage from the RTC battery 118 when the computer N is turned off and the main battery 52 is not present.

Assume the notebook computer N is turned on so that the +5 V signal is energized to 5 volts. This causes the transistor 106 to be activated, which in turn activates or turns on the transistor 100 so that the current can flow from the +5 V signal through the resistor 112 and the diode 128 to the RTC/CMOS memory section 26. As the transistor 106 is activated, the gate voltage on the MOSFET 110 is low, so that the RTC battery 118 is disconnected from ground and open circuited. In this manner, the lithium battery is not charged during power on operations, thus preventing damage to the battery 118.

Also, when the +5 V signal is energized at 5 volts, the MOSFET 122 is activated so that the gate to the MOSFET 124 is at approximately ground voltage and thus the MOSFET 124 is turned off. When the +5 V signal is deasserted the MOSFET 122 is deactivated and the MOSFET 124 is activated through the resistor 120. This causes the resistor 126 to effectively be connected between the +5 V signal and ground, thus providing a relatively low impedance connection to prevent backfeed voltages from developing in the notebook computer N if it is connected to external components which can provide power.

If the +5 V signal is not present, then the transistor 106 is deactivated or opened. In this case, current flows from the capacitors 114 and 116 or the RTC battery 118 through the collector to base diode junction of the transistor 100 and through the resistor 108 to provide voltage to the gate of the MOSFET 110. In this manner the MOSFET 110 is turned on when the transistors 106 and 100 are deactivated. This allows the RTC battery 118 to be connected to ground to provide energy if necessary.

If the VBATT signal is present, indicating that the battery 52 is installed, and the +5 V signal is not present, indicating that the computer N is turned off, then the RTCVCC signal is provided through the JFET 134 in the following manner. It is noted that the gate to the JFET 134 is connected to ground. In this manner should the RTCVCC circuit effectively start at ground for analysis purposes, then the JFET 134 has a $V_{GS}$ of 0, so that the current through the JFET 134 is very high. This would then result in an increased voltage to the source of the JFET 134 as the capacitor 130 charges, which in turn would reduce the current through the JFET 134 based on conventional JFET characteristics. Ultimately the voltage would then theoretically increase at the source until no current was transmitted, such that the JFET 134 cuts off. However, as current is actually utilized by the RTC/CMOS memory 26, this cutoff or zero current condition will not be reached. However, because of the current required by the CMOS/RTC memory section 26 is quite low, on the order of 10 μA for the preferred peripheral and I/O chip 24, the voltage at the RTCVCC signal will actually be quite close to the gate to source cutoff voltage of the JFET 134. By properly selecting the cutoff voltage to be in the operating region of the RTC/CMOS memory section 26, preferably 3 to 5 volts in the preferred embodiment, then the voltage provided to the RTC/CMOS memory section 26 is within the desired region for its operation. As the leakage current of the JFET 134 is preferably very small and very little power is actually consumed in the resistor 136 as only the RTC/CMOS memory section current 26 is flowing through it, very little energy is actually lost to the system by the use of the regulator formed using the JFET 134. As there is very little energy lost, the main battery 52 can be readily utilized to power the RTC/CMOS memory section 26. This allows the RTC battery 118 to remain off line when the battery 52 is present as the RTCVCC signal voltage will be greater then the voltage provided by the RTC battery 118 and the voltage needed to cause the diode 128 to conduct. Thus the RTC battery 118 is not discharging and its operating life will be greatly increased. The circuit therefore provides very low quiescent current voltage regulation with a minimal number of components, namely the diodes 128 and 132, the JFET 134 and the resistor 136, thus taking up very little space and adding a small cost and yet allowing the great extension of the RTC battery 118 life.

If the computer N is turned off, so that the +5 V signal is not provided, and the main battery 52 is not present, the RTC battery 118 provides the energy to the RTCVCC signal. Because no voltage is present on the VBATT signal, and the diode 132 prevents any back feeds, the RTCVCC signal voltage is not more than a diode drop greater than the voltage of the RTC battery 118, so the diode 128 is conducting and the RTC battery 118 provides the energy to the RTC/CMOS memory section 26. Thus, only when both the computer N is turned off and the main battery 52 is removed does the RTC battery 118 supply power. As this is an unusual condition, the RTC battery 118 provides energy only for very short periods and its life is greatly extended.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

I claim:

1. A low quiescent current voltage regulator circuit comprising:

a high voltage source providing a positive voltage and ground;

a ground connected load designed to operate at a voltage below the level of the positive voltage of said high voltage source and having a small current draw; and a junction field effect transistor having its gate connected to ground, its drain connected to the positive voltage provided by said high voltage source and its source connected to said load, wherein the gate to source cut off voltage of the junction field effect transistor is approximately the operating voltage of said load.

2. A circuit for providing a voltage to a continuous, low current load in a notebook computer, the notebook computer including a removable battery providing ground and a high positive voltage and a power supply circuit for providing a computer operating voltage developed from the high positive voltage provided by the removable battery and capable of being turned on or off to turn the computer on or off, the load utilizing a voltage less than the positive voltage provided directly by the battery, the circuit comprising:

means connected to the load and to the power supply circuit for providing the computer operating voltage to the load when the computer is turned on; and a low quiescent current voltage regulator connected to the high positive voltage of the removable battery and the load for providing a voltage utilized by the load when the computer is turned off and the removable battery is present, wherein said low quiescent current voltage regulator comprises a junction field effect transistor having its gate connected to ground, its drain connected to the high positive voltage of the removable battery and its source connected to the load, and wherein the gate to source cutoff voltage of said junction field effect transistor is approximately the voltage utilized by the load.

3. The circuit of claim 2, further comprising:

a low energy battery connected to the load for providing a voltage utilized by the load when the computer is turned off and the removable battery is removed.

4. The circuit of claim 2, wherein said means for providing the computer operating voltage includes:

a PNP transistor having its emitter connected to the computer operating voltage and its collector coupled to the load; and an NPN transistor having its emitter connected to ground, its base coupled to the computer operating voltage and its collector coupled to the base of said PNP transistor.

5. The circuit of claim 4, further comprising:

a battery transistor connected between the negative terminal of said low energy battery and ground and to the collector of said NPN transistor so that said battery transistor connects said low energy battery to ground when said NPN transistor is off and disconnects said low energy battery from ground when said NPN transistor is on; and wherein said low energy battery has its positive terminal coupled to the collector of said PNP transistor.

6. The circuit of claim 2, wherein said means for providing the computer operating voltage includes:

a PNP transistor having its emitter connected to the computer operating voltage and its collector coupled to the load; and an NPN transistor having its emitter connected to ground, its base coupled to the computer operating voltage and its collector coupled to the base of said PNP transistor.

* * * * *